US009759529B2

(12) United States Patent
Childs et al.

(10) Patent No.: US 9,759,529 B2
(45) Date of Patent: Sep. 12, 2017

(54) ATTACK COUNTERMEASURE DEVICE AND METHOD

(71) Applicants: Bruce D. Childs, Chagrin Falls, OH (US); Lori A. O'Neill, Chagrin Falls, OH (US)

(72) Inventors: Bruce D. Childs, Chagrin Falls, OH (US); Lori A. O'Neill, Chagrin Falls, OH (US)

( * ) Notice: Subject to any disclaimer, the term of this patent is extended or adjusted under 35 U.S.C. 154(b) by 0 days.

(21) Appl. No.: 14/801,744

(22) Filed: Jul. 16, 2015

(65) Prior Publication Data

US 2016/0018194 A1 Jan. 21, 2016

Related U.S. Application Data

(60) Provisional application No. 62/025,372, filed on Jul. 16, 2014.

(51) Int. Cl.

| | |
|---|---|
| ***F41H 9/10*** | (2006.01) |
| ***F41C 33/06*** | (2006.01) |
| *F41A 23/18* | (2006.01) |

(52) U.S. Cl.

CPC ..... *F41H 9/10* (2013.01); *F41C 33/06* (2013.01); *F41A 23/18* (2013.01)

(58) Field of Classification Search

CPC ..... F41H 9/10; F41C 33/06; F41A 23/18

USPC ..... 222/173, 179.5

See application file for complete search history.

(56) References Cited

U.S. PATENT DOCUMENTS 4,309,065 A * 1/1982 Pappas ..... A47B 81/005 224/912

2012/0118990 A1* 5/2012 Beever, III ..... F41B 9/0025 239/1

FOREIGN PATENT DOCUMENTS

WO WO 2006055640 A2 * 5/2006 ..... C06D 7/00

* cited by examiner

*Primary Examiner* — Donnell Long

(74) *Attorney, Agent, or Firm* — D. A. Stauffer, Patent Agent

(57) ABSTRACT

A device and method for countering, i.e., disrupting an attack by a dangerous assailant, particularly in a public space such as a classroom. A pressurized spray canister contains oleoresin capsicum (OC), a.k.a. pepper spray, in a gel formulation, and the canister is adapted for spraying a jet of the OC gel that is concentrated in the area of a person's head located up to 25 feet away from a user. To prevent misuse, the canister is securely stored in a box having a door with a latch for resisting non-emergency access to the canister stored in the box. A gel formulation has been selected for properties, in addition to its powerful pepper (OC) effects, that enhance defense including opaque, sticky, high density coverage, and brightly colored long lasting stains.

9 Claims, 5 Drawing Sheets

TOP VIEW

FRONT VIEW

SIDEVIEW

ATTACK COUNTERMEASURE DEVICE AND METHOD

CROSS-REFERENCE TO RELATED APPLICATIONS

This application claims the benefit of U.S. Provisional Patent Application No. 62/025,372, filed Jul. 16, 2014, said application hereby incorporated in its entirety by reference herein.

BACKGROUND OF THE INVENTION

School shootings have been a recurring problem in American schools for decades. The massacres at Columbine High School in 1999 and Virginia Tech University in 2007 forced the nation's educational institutions to tighten security protocols and train students on lockdown procedures in the event of an attack. Since the horror of the shooting at Sandy Hook Elementary School in Newtown, Conn. in December 2012, K-12 schools, and colleges and universities, have spent millions of dollars to install access control systems, strengthen classroom doors, invest in radio communications equipment, and train teachers, administrators and students how to respond in the event of a violent incident. Despite these efforts, there have been 74 violent attacks at schools and colleges in the US with more than 35 killed, and over 100 injured in the 17 months since Sandy Hook.

Law enforcement experts acknowledge that a determined person will find a way past access control systems, and the average 7-14 minutes it takes first responders to reach the scene means it is up to teachers and administrators to save themselves and their students. But current training protocols fall short of providing effective countermeasures to stop a violent attack.

The most popular training protocol adopted by schools following Sandy Hook calls for students and teachers to throw books, pencils and small objects at a shooter who enters the classroom, then physically swarm him to stop an attack. The protocol may be preferable to passive victimhood, but it unnecessarily endangers students and teachers by forcing them to become visual targets as they stand to throw things, and to physically attack an armed assailant. Proximity to an attacker increases the risk of injury and death. Many educators are concerned about the ineffectiveness and danger of the current approach and are searching for a more effective way to counter a violent attack, without having to arm teachers with firearms.

BRIEF SUMMARY OF THE INVENTION

According to the invention a powerful delivery system for a carefully selected formulation of a Pepper-Based Defense Product (PBDP) e.g., Oleoresin Capsicum (OC), a.k.a. "pepper spray/gel/foam" in a secure but quickly accessible storage box is provided to give staff members, particularly in public buildings, a non-lethal defensive countermeasure to disrupt a violent intruder, active shooter, or other physical attacker and minimize loss of life and injuries while they wait for first responders to arrive.

The inventive apparatus and method of deployment allows the user to maintain a safe distance from an assailant while deploying a powerful dose of OC such as pepper gel to disrupt the attack. It does not require the user or bystanders like students, residents, customers, or other employees to expose themselves to further danger, and is simple to use, especially with a relatively small amount of training.

The invention is particularly suitable for use by teachers, administrators, managers, or other designated staff members in public buildings (for example: day care centers, schools at all levels, dormitories, public housing, health care facilities, retail establishments, manufacturing and warehouse facilities, governmental facilities, and offices).

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar (including identical) elements may be referred to with similar numbers in a single drawing. For example, each of a plurality of elements collectively referred to as 199 may be referred to individually as 199a, 199b, 199c, etc. Or, related but modified elements may have the same number but are distinguished by primes. For example, 109, 109', and 109" are three different versions of an element 109 which are similar or related in some way but are separately referenced for the purpose of describing modifications to the parent element (109). Such relationships, if any, between similar elements in the same or different figures will become apparent throughout the specification, including, if applicable, in the claims and abstract.

Figure 1:
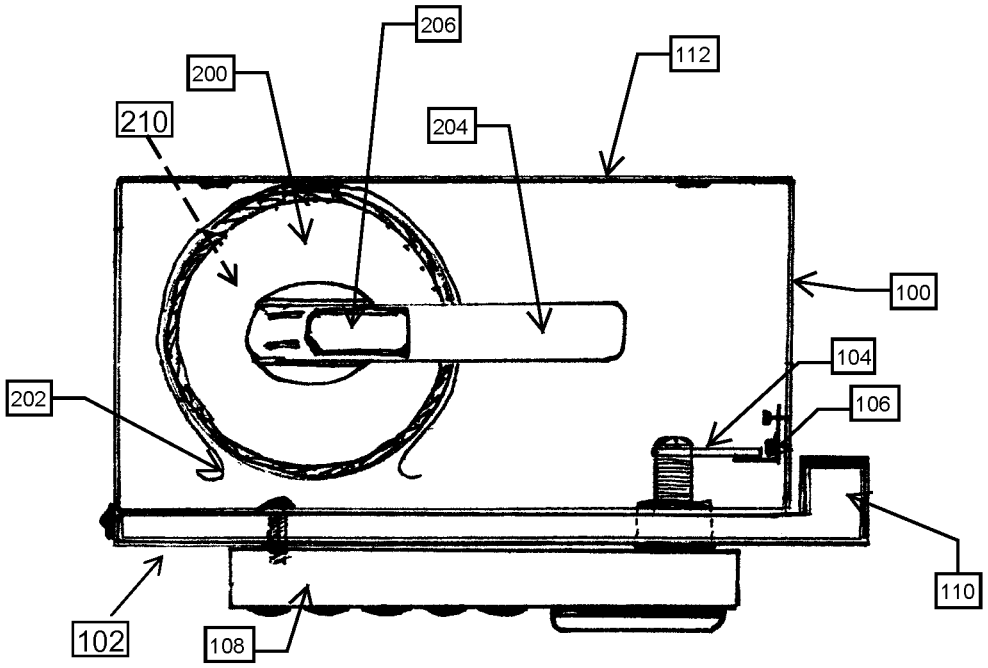

The structure, operation, and advantages of the present preferred embodiment of the invention will become further apparent upon consideration of the following description taken in conjunction with the accompanying drawings, wherein:

FIG. 1 is a top view (top wall omitted) of an attack countermeasure device including a spray canister in a secure storage box, all according to the invention.

Figure 2A:
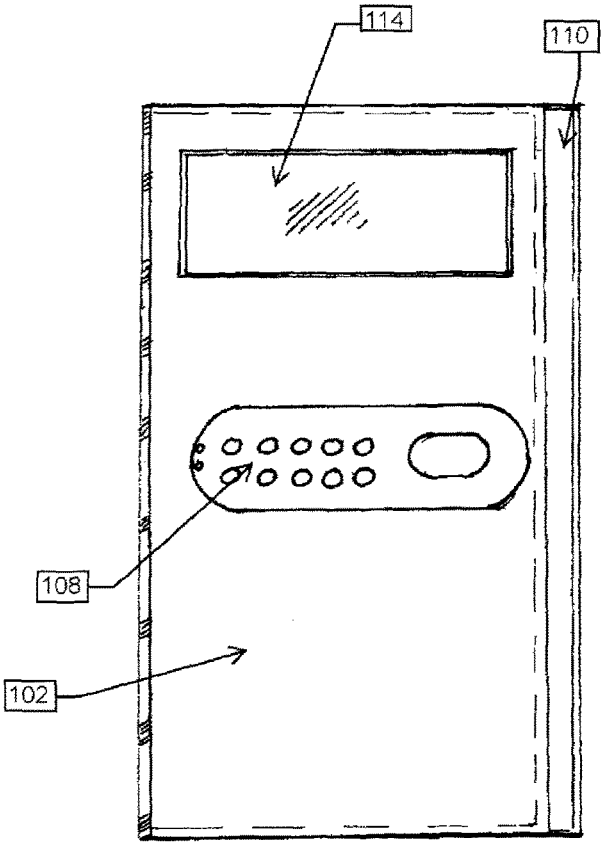
Figure 2B:
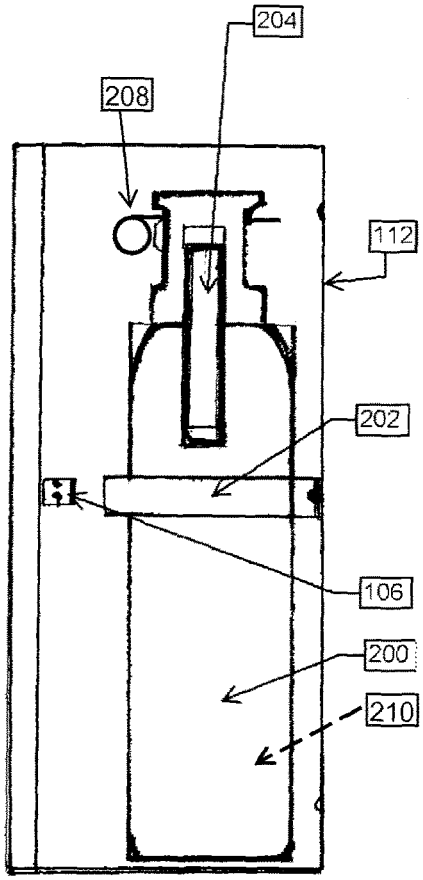

FIGS. 2A and 2B are front, and side (side box wall omitted) elevational views, respectively, of an attack countermeasure device according to the invention.

Figure 3:
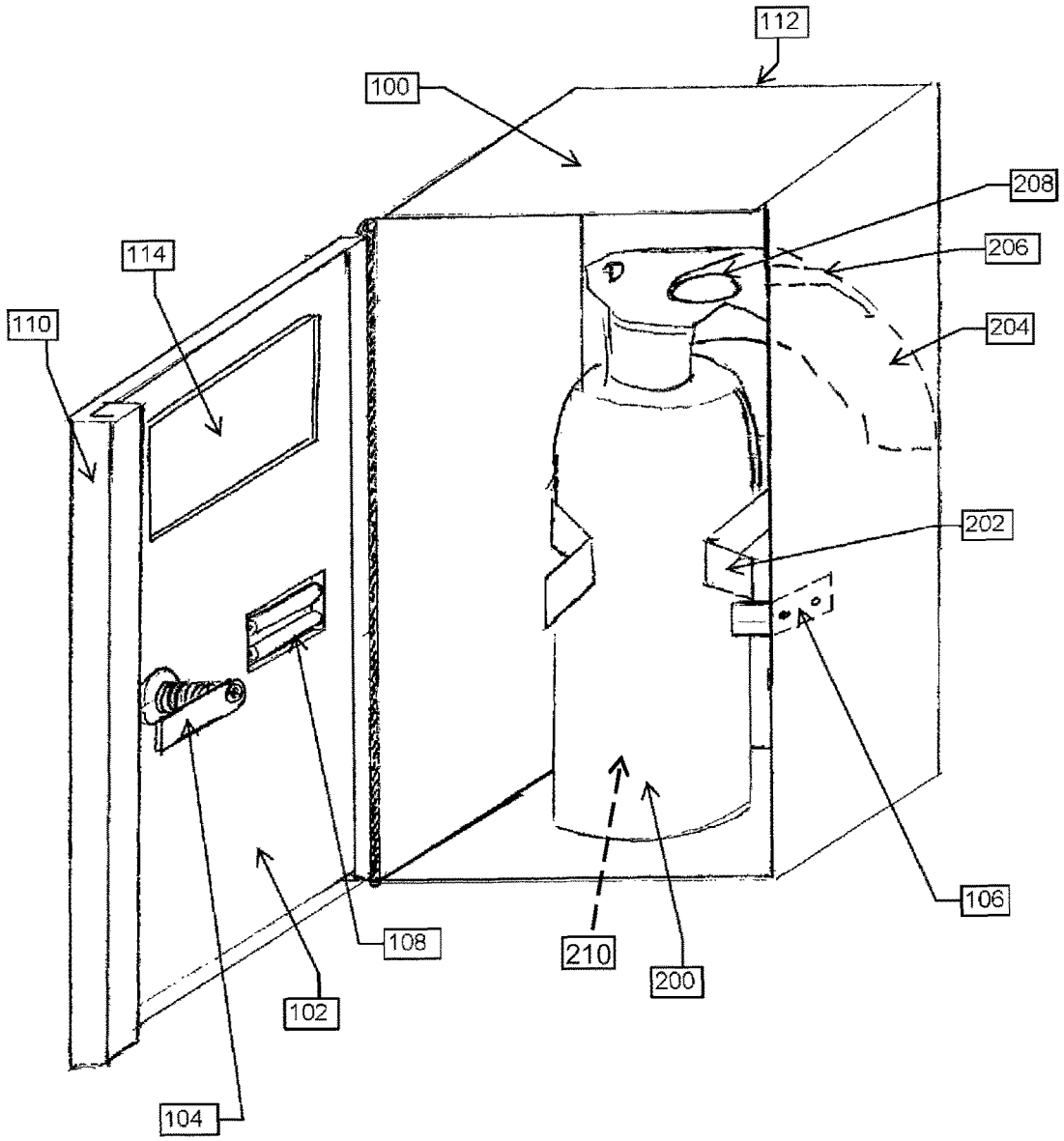

FIG. 3 is a front upper right perspective view of an attack countermeasure device when an access door to the box is opened, all according to the invention.

Figure 4:
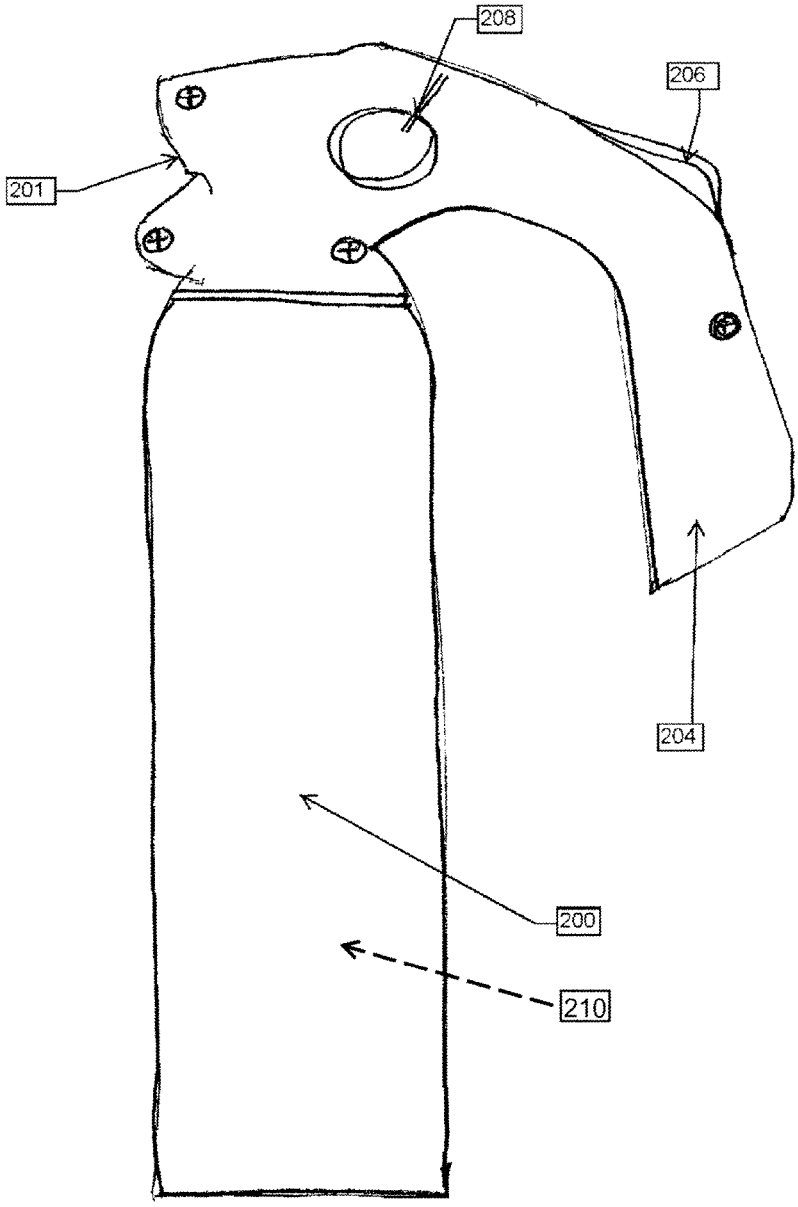

FIG. 4 is an elevational view of a spray canister part of an attack countermeasure device according to the invention.

Figure 5:
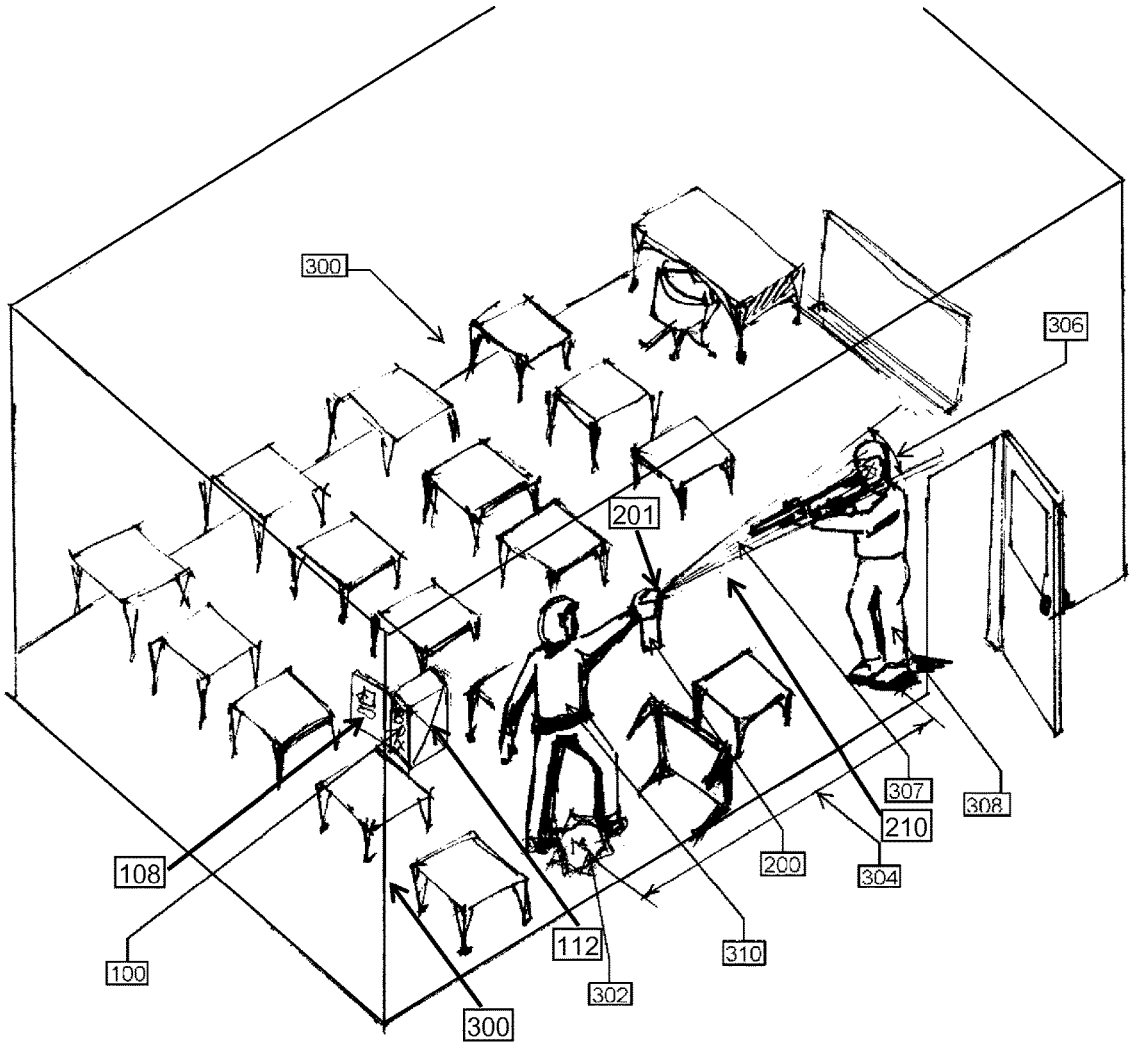

FIG. 5 is a schematic perspective view (room walls omitted) illustrating an example installation of the attack countermeasure device, and showing implementation of an attack countermeasure method, all according to the invention.

DETAILED DESCRIPTION OF THE INVENTION

The following table is a glossary of terms and definitions, particularly listing drawing reference numbers or symbols and associated names of elements, features and aspects of the invention(s) disclosed herein.

| REF. | TERMS AND DEFINITIONS |
|---|---|
| | SECURE STORAGE BOX |
| 100 | Box |
| 102 | Access door |
| 104 | Latch |
| 106 | Tab |
| 108 | Latch actuating mechanism, optionally including area communications and remote control gear |
| 110 | Door handle |
| 112 | Back wall of box, which is mounted on a building wall or similar structure |
| 114 | Window for viewing inside the box |
| | PBDP (PEPPER BASED DEFENSE PRODUCT) |
| 200 | Canister (Spray Canister, OC Canister) adapted for spraying OC gel |
| 201 | Nozzle adapted for directing OC gel in a relatively horizontal, narrow cone for a 25-30' distance |
| 202 | Bracket |
| 204 | Handle |
| 206 | Trigger |
| 208 | Safety locking pin |
| 210 | Pepper gel (stored in canister 200), Oleoresin Capsicum (OC) in a gel formulation |
| | INSTALLATION AND METHOD OF USE |
| 300 | Classroom |
| 302 | Marker decal |
| 304 | Horizontal travel distance of pepper gel jet |
| 306 | Cone angle spread of pepper gel jet |
| 307 | Pepper gel jet, particularly indicating the jet centerline (trajectory) |
| 308 | Attacker |
| 310 | Defender |

The invention(s) will now be described with reference to the drawings using the reference numbers and symbols listed in the above table. The invention is characterized by at least some of the following elements and features, both as apparatus and, wherever appropriate, as steps or elements of the inventive method of deployment and use thereof:

An enclosure, box 100 made of a sufficiently strong and durable material (e.g., metal, plastic, fiberglass-reinforced material) for securely storing a pressurized canister 200 of PBDP 210, and having a door 102 for accessing the PBDP when needed.

For security the box door 102 is held in a closed position (latched) by a locking mechanism such as, for example, a latch 104 and tab 106 inside the box, a magnetic lock closure 104, an electronic latch 108, and the like.

A handle 110 is provided for helping open the box door 102. In an embodiment the handle is near the door edge opposite a hinge. This handle is designed to enable opening the box 100 by application of moderately substantial human force if the user is unwilling or unable to open the latch 104, 108 by means of its key or combination in an emergency situation, or if the door 102 is designed to be without any external unlocking mechanism. The internal latch 104 and/or tab 106 is designed to break or bend out of the way under the applied force. In a preferred embodiment, the applied force needed to open the door this way is about 10 to 40 pounds, most preferably about 30 pounds (133 N.)

In another embodiment, the handle 110 is a lever that is mounted on a sidewall of the box such that operating it will push outward against an edge of the door 102.

The back wall 112 of the box is designed to be mounted on a building wall or other fixed structure, in a location accessible to designated persons who may use it for defensive purposes. The mounting means and supporting structure are strong enough to resist the door opening force without breaking or pulling apart.

The box 100 may contain a battery operated alarm that is activated when the box is opened to notify designated personnel that the box has been accessed, and/or to alert occupants of a room or building that there is an emergency by virtue of the box being opened to access the OC canister(s) 200 inside. The interior mounted alarm may be a continuous alarm, or an alarm that can be disarmed upon entry into the box. The alarm may be a loud audible sound, or a silent alarm that is transmitted elsewhere, e.g., by a wireless transmitter. The alarm and/or transmitter may be part of the electronic latch 108 which is also battery operated.

The box 100 may be connected via wireless technology 108 to other boxes 100 in a facility such that when an audible emergency notification system is activated to alert occupants of the facility of an emergency, the wireless system that connects the boxes is programmed to release an electronic (e.g., magnetic) locking system 108 on the boxes such that the locking mechanism 104 on all boxes is released simultaneously so that occupants or designated operators can access a box anywhere in the facility without having to disengage the locking mechanism manually. Additionally, the wireless technology connecting the boxes may be accessed by designated personnel via smartphone enabled emergency notification applications such that upon learning that a facility or persons in a facility are under attack, the person may set off the alarm via smartphone such that the locking mechanism 108, 104 on all boxes 100 in the facility will simultaneously disengage to allow access to the boxes. Additionally, when the emergency notification alarm is set off, local police, fire departments and/or emergency medical services may also be notified of the attack so that they can respond to the location of the attack. A feature of the alarm notification inside a facility may be a human voice saying "emergency, emergency, we are under attack." This voice recorded alarm notification may be more distinctive than a typical siren sound or other known type of alarm sound so that people occupying a facility will know instantly that this is a violent event, not a fire, weather or medical emergency, and will not confuse the alarm for other types of emergency situations.

The box door 102 may be equipped with an electronic or mechanical key operated latch actuating mechanism 108 such as a barrel lock with key, an electronic keypad lock (as shown in FIG. 2), a mechanical keypad lock, and the like. Optionally, it may have no latch actuating mechanism 108. When the mechanism 108 is absent, the latch 104 cannot be actuated from the outside and is factory-installed in the closed position. In this case the handle 110 may be used to force open the door as described above.

The canister 200 of PBDP is removably mounted to a bracket 202 affixed to the interior of the box opposite the door.

In a preferred embodiment, the box has a window 114 in the front door that provides a visual confirmation that the PBDP canister is present inside. This window is small enough to prevent removal of the canister through it.

In a preferred embodiment of the inventive attack countermeasure method as shown in FIG. 5, one or more decals 302 are affixed to the floor or ceiling of the classroom, office, or other indoor area 300 being protected, at one or more spots chosen to provide optimal accuracy, speed, distance and effectiveness of response to the attacker.

In a preferred embodiment, the PBDP canister 200 comprises a nozzle 201, a handle 202, a trigger 206 attached to or near the handle, and a removable trigger locking means 208. In a more preferred embodiment, this safety locking means 208 is a pin with a grab ring, wherein the pin is inserted through the handle 202 to block the trigger 206. The pin is removed quickly and easily to operate the unit.

In a preferred embodiment, the handle 204 of the OC canister 200 is made of an orange material to indicate to law enforcement that the canister is not a lethal weapon, much as airsoft guns, BB guns and other facsimile guns are required to be manufactured so that law enforcement can quickly visually identify a potential weapon as non-lethal.

In a preferred embodiment, the trigger mechanism 206 on the OC canister 200 is a type that is operated by simply pressing a thumb downward on it.

In an alternative embodiment, the box 100 can be configured to hold two or more OC canisters 200 that may be individually bracket mounted side by side.

In a preferred embodiment, the formulation of the PBDP (OC) 210, and the canister 200 that sprays it, are designed so that the PBDP jet 307, when released through the canister's nozzle 201, travels a horizontal distance 304 of at least 15 feet, and such that at 25 feet (8 meters) it has a cone angle spread 306 of no more than 3 feet (1 m), and preferably the centerline 307 drops less than about 1 foot (30 cm).

One product that meets the foregoing requirements is a pressurized pepper gel spray canister.

In a preferred embodiment, the pepper gel 210 contained in the canister 200 has a bright red or orange color and is substantially opaque, though for use in consumer settings such as homes or apartments or other residences such as trailers or mobile homes, the red orange color may be modified so as to prevent permanent staining of furniture, flooring, fabrics and the like.

In a further preferred embodiment, the pepper gel 210 contains an invisible dye that adheres to human skin for an extended period of time, even after the gel is washed off. The dye luminesces under ultraviolet light for forensic identification.

Selection of Pepper-Based Defensive Product

Having evaluated all available weapon types and tactics to defend against an attack, the inventors concluded that Oleoresin Capsicum (OC) generically known as pepper-based defensive products (PBDPs) are the most desirable option for the following reasons:

PBDPs are extremely effective at disrupting and temporarily disabling attackers, yet they are non-lethal, posing no threat of permanent injury or death to attackers or bystanders.

Anyone can be trained to use OC pepper-based products effectively. They do not require a high level of skill, and under duress, when people lose fine motor skills, they can be deployed easily using only gross motor skills If unintended contamination of innocent bystanders occurs, it is simple to treat OC pepper-based product exposure with a combination of water and air. The effects can be mitigated within 30-45 minutes with no permanent harm to those exposed.

Oleoresin Capsicum (OC) is the ingredient in pepper-based defense products that causes the physiological and psychological responses that impair violent actions. OC is available in spray, foam and gel formulations. Preferred embodiments of the invention use the gel formulation.

Most manufacturers of pepper spray sell it in a colorless formulation that is clear when deployed. Some attackers may wear protective clothing that includes a face mask that protects the eyes and respiratory system, e.g., goggles and respirator, or eyeglasses at a minimum. If clear pepper spray products are deployed at an assailant wearing a protective mask, it would have little effect in disrupting the attack as the attacker would be able to maintain enough visual acuity to aim a firearm or other weapon. Therefore, a diffusing or opaque spray that sticks to eye covering is preferred, a gel for example.

Some manufacturers of pepper spray products leave in the natural color of the peppers from which the oleoresin capsicum is derived, a red-orange. The natural color in a pepper spray product allows users to see if they are hitting a target, and thus have the ability to correct their aim or spray pattern, and to visually impair assailants who wear protective masks. If a colored pepper spray is deployed at the protective mask of an assailant, he has to remove his mask to continue to operate visually, which exposes his eyes, nose and mouth to a second shot.

Aerosol spray is the most common PBDP formulation. However, this disperses in a relatively wide-angle cone as a fine mist that will spread beyond the cone. Therefore, collateral contamination (e.g., of bystanders) is extensive. Deploying a mist/aerosol spray formulation in an enclosed space causes significant exposure of all persons present in that space, defeating the ability to target only the assailant. The spray may also escape into heating/ventilation systems, spreading the product throughout the building.

Foam formulations are thick and viscous, so they cannot be projected at distances of more than about 6-8 feet. Using pepper foam requires the user to get dangerously close to an assailant in order to reach the target. Additionally, violent people have been known to simply scoop the foam off their faces and throw it to the floor when hit with this formulation.

The inventors concluded that the gel formulation of OC is the most desirable of the three for the purpose of the inventive product. Pepper gel has the consistency of shaving gel, and can be projected effectively for a distance 304 of about 25 feet or so, thus eliminating the need to get close to an attacker. Additionally, the cone angle 306 of a gel jet is narrow, so that the gel 210 can be targeted narrowly at an assailant 308 and cause little collateral contamination to other persons in the area. It does not vaporize broadly into the air, which further protects other persons in the room 300, and therefore it does not contaminate heating/ventilation systems. Pepper gel sticks to the assailant (or protective masks) but liquefies very quickly so he cannot simply scrape it off his face or clothing.

For these reasons, the OC product preferred in the inventive product is a naturally colored (red-orange) pepper gel that can project up to 25 feet when deployed, and causing little collateral contamination to bystanders or first responders. Even better, the ideal pepper gel formulation can also contain a UV-luminescent dye that cannot be removed from the skin for an extended period of time. Dyes retaining their effectiveness up to 24 hours are commercially available. The UV-luminescent dye helps law enforcement agents identify a perpetrator for up to 24 hours after commission of a crime simply by scanning his skin with a UV light source.

A specific commercial example of the red pepper gel with UV die is SABRE* Red 92H2060-G produced by the Security Equipment Corporation of Fenton, Mo., USA, as shown at the following Internet web page: www.sabrered-.com/servlet/the-template/LawEnforcement-dsh-Crowd-Management/Page

*The name SABRE may be trademarked.

Floor/Ceiling Markers

Referring to FIG. 5, there are strategically located points in a room 300 from which a defender 310 can best surprise and accurately hit an assailant 308 with a defensive pepper gel jet 307. These locations depend on the placement of entry points (e.g. doors), concealing objects (e.g. furniture), and the box 100. Furthermore, a maximum recommended jet travel distance 304 (e.g., 25 feet) must be accommodated. It may be difficult for a responsible staff member to judge all these factors optimally in a stressful emergency situation. Therefore, a recommended step in our defensive method is to determine and mark one or two best defensive positions 302 in advance. The marking can be achieved by means of durable colored decals 302 adhering to the floor. To avoid drawing too much attention in normal times, or to minimize wear, the decals could also be placed overhead on the ceiling. In the example illustrated by FIG. 5, the decals are placed at a recommended distance of 17 feet—well within the effective jet spray distance of 25-30 feet so as to improve aim, but still reasonably far away for safety sake.

Canister Design

Preferably, the canister 200 has a safety locking pin 208 with a pull ring, similar to the pin commonly found on fire extinguishers. This helps even a panicky user to recognize the pin 208 as something that must be removed before use. The pin prevents premature squeezing of the trigger 206 by a nervous user. It slides out easily in a single motion. This makes operation of the unit simple, without requiring fine motor skills.

The canister 200 has an orange handle 204 and/or orange nozzle 201 so that law enforcement agents responding to an active shooter or violent attack will not mistake the pepper gel canister 200 for a firearm or other lethal weapon. Orange is universally recognized by law enforcement as an indicator of a non-lethal weapon or toy. In the chaos of a violent attack, the user of the pepper gel is trained to take the unit with them when they evacuate, and the orange top visually signals to law enforcement that the holder of the canister 200 is not an assailant.

Although the invention has been illustrated and described in detail in the drawings and foregoing description, the same is to be considered as illustrative and not restrictive in character—it being understood that the embodiments shown and described have been selected as representative examples including presently preferred embodiments plus others indicative of the nature of changes and modifications that come within the spirit of the invention(s) being disclosed and within the scope of invention(s) as claimed in this and any other applications that incorporate relevant portions of the present disclosure for support of those claims. Undoubtedly, other "variations" based on the teachings set forth herein will occur to one having ordinary skill in the art to which the present invention most nearly pertains, and such variations are intended to be within the scope of the present disclosure and of any claims to invention supported by said disclosure.

What is claimed is:

1. An attack countermeasure device for use in public buildings, comprising:

a pressurized spray canister containing oleoresin capsicum (OC) in a gel formulation that is colored and substantially opaque, the spray canister being adapted for spraying a jet of the OC gel more than about 20 feet away with a cone angle spread of no more than 3 feet at 25 feet away, and wherein a gel-containing cylinder extends downward from a pistol-like handle with a thumb operated trigger; and a wall-mounting box adapted for minimally secure storage of, and quick access to, the spray canister, the box adaptation comprising a box door with a latch that is electably forced open by a user's application of about 10 to 40 pounds of force.

2. The attack countermeasure device of claim 1 wherein: the box is force openable by a user's application of about 30 pounds force.

3. The attack countermeasure device of claim 1 wherein: the box door has a handle to help a user in forcing the box open.

4. The attack countermeasure device of claim 1 wherein: the box has a lever to help a user in forcing the box open.

5. The attack countermeasure device of claim 1 wherein: the spray canister is adapted for spraying a jet of the OC gel about 25 to 30 feet away from a user.

6. The attack countermeasure device of claim 1 further comprising:

a UV luminescent dye in the OC gel that is invisible and adheres to human skin after the gel is washed off.

7. The attack countermeasure device of claim 1 wherein: the spray canister is brightly colored to avoid the appearance of a lethal weapon.

8. The attack countermeasure device of claim 1 further comprising:

a window in the box door.

9. The attack countermeasure device of claim 1 wherein: the latch comprises a locking mechanism selected from the group consisting of: a latch and tab inside the box, a magnetic lock closure, an electronic latch, a key lock, a combination lock, a keypad lock, and an electronic locking system with wireless technology operably connecting a plurality of the boxes.

* * * * *